United States Patent [19]

Smith et al.

[11] Patent Number: 4,688,965

[45] Date of Patent: Aug. 25, 1987

[54] EXTENDABLE SCREED AND METHOD FOR PAVING NON-COPLANAR ROAD SURFACE

[75] Inventors: Donald Smith, Aurora; George Goehst, Plano, both of Ill.

[73] Assignee: Barber-Greene Co., DeKalb, Ill.

[21] Appl. No.: 866,907

[22] Filed: May 27, 1986

[51] Int. Cl.[4] ..... E01C 19/22

[52] U.S. Cl. ..... 404/75; 404/118

[58] Field of Search ..... 404/72, 75, 96, 101, 404/104, 118

[56] References Cited

U.S. PATENT DOCUMENTS

| | | | |
|---|---|---|---|
| 3,559,544 | 2/1971 | Miller | 404/96 |
| 3,636,831 | 1/1972 | Davin et al. | 404/104 X |
| 3,992,124 | 11/1976 | Schrader | 404/118 |

OTHER PUBLICATIONS

Barber-Greene Extend-A-Mat Variable Width Screeds ad., Release 102, p. 6785.

ABG Variomatic Screed, Titan ad.

ABG Paver Finisher, Titan 355 ad.

*Primary Examiner*—Stephen J. Novosad

*Assistant Examiner*—Matthew Smith

*Attorney, Agent, or Firm*—Jones, Day, Reavis & Pogue

[57] ABSTRACT

An improved extendable screed for paving non-coplanar road surfaces with a screed having discontinuous strike plate portions which can be adjusted to define two planes of road surface. The screed is divided into two portions, each comprised of two parts reversibly held together with bolts. The portions may be lengthened by insertion of an extension section in one or both portions. A support system is provided which will allow the support arms of the screed and the pulling vehicle to be connected even though the extended screed is wider than the tractor. The screed and associated support system may be used in a method for paving non-coplanar roads by orienting the screed division-line in line with the center-line of the crown of the road while the center-line of the tractor, corresponding to the center-line of the screw-augers which distribute the paving material to the screed, is oriented with the center-line of the screed, so the augers more evenly draw paving material from each of the paver feeders.

7 Claims, 9 Drawing Figures

EXTENDABLE SCREED AND METHOD FOR PAVING NON-COPLANAR ROAD SURFACE

BACKGROUND OF THE INVENTION

The invention relates to road paving screeds and methods for supporting and using screeds. In particular, the invention pertains to screeds having changeable widths, and to methods of paving non-coplanar roads.

In the past, it has been desired to have screeds with varying width (otherwise referred to in this specification as the longitudinal dimension) on one or both sides to accomodate paving of road surfaces of varying widths. Most recently, changeable screed width has been accomplished by hydraulically operated extendable mats which can quickly extend up to 5-foot sections of screed at either or both longitudinal ends of the screed, as Barber-Greene Company's Extend-A-Mat commercial product is capable of doing. Such devices also provide for slope control to allow paving of a non-coplanar shoulder at an angle divergent from the main road surface at one side of the main road surface. The commercially available Extend-A-Mat screeds come in an 8-foot model which extends to 15 feet, 6 inches, and a 10-foot model which extends to 19 foot, 6 inches. However, even these dimensions are not adequate for many road paving jobs.

Continued efforts to widen the screed itself, and/or the hydraulically driven Extend-A-Mat sections, have met significant problems. For example, extending the main portion of the screed beyond ten feet creates transportation problems because screeds wider than ten feet cannot easily be moved from one location to another, or may require special wide load permits during transportation. Adding width to the Extend-A-Mat sections, in addition to increasing the overall longitudinal dimension of the screed, create problems of severe stress on the support mechanism of the Extend-A-Mat sections because of the cumulative pressure of the paving material against the extended portions as they are pulled across the road. Furthermore, when one Extend-A-Mat wing is extended while the other one is not extended (or is not as fully extended), the center-line of the longitudinal dimension of the screed including the wing is different from the center-line of the vehicle that distributes the paving material. Accordingly, the feeders which bring material from the paver hoppers will have to provide more paving material to one side than the other. This can result in emptying one side of the paver hopper while the other side has substantial material remaining, thus preventing the hopper from completely emptying. This creates problems in discharging material from dump trucks into the paver hopper.

More recently a West German company, Allgemeine Baumashinen-Gesellschaft (ABC)—Gerhard L. Pottkamper GmbH & Co. KG, has produced a screed which can be extended by insertions of screed sections longitudinally outside of the screed support arms but inside the extendable-mat sections. No provision is made which allows the shifting of the screed widthwise relative to the vehicle nor is the non-symetrical addition of screed sections shown.

It is an object of the present invention to provide a support means allowing for longitudinally shifting of the screed relative to the pulling vehicle.

It is another object of the present invention to provide an improved extendable screed which allows paving a roadway in a single pass even though the crown of the road is divergent from the center-line of the vehicle pulling the screed.

It is yet another object to provide an apparatus and method of paving wherein the division-line of the screed may be shifted so that the paver feeders supplying material to the screed will be feeding more equal volumes of paving material to each side of the screed.

It is further an object of the present invention to provide a screed support system which allows for the support arms of the tractor and the screed to be adequately joined and supported even though the support arms of the screed have been separated by insertion of extension sections.

Other and further objects will become apparent from the following discussion of the invention and its embodiments.

SUMMARY OF THE INVENTION

In accordance with this invention, an extendable screed has two separate strike plate portions connected at the bottom by a bottom plate, and at the top by worm screw joint. The worm screw joint deviates orientation of the strike plate portions from parallelism with each other within the strike plate plane by widening or shortening the distance at the top of the strike plates between one another, thereby flexing the bottom plate. The space between the strike plate portions defines a "division-line" in the screed. Each portion of the screed is itself divided into two parts which are reversibly connected to each other for insertion of one or more extension sections. Accordingly, one or both portions of the screed can be reversibly increased in length by a variable amount.

The screed is normally connected to the tractor (or other vehicle which pulls the screed behind it) by support arms which are connected to screed support arms located at either longitudinal end of the screed. Of course, if the screed is widened on one or both sides the support arms will no longer interface directly with the support arms of the vehicle. The present invention provides a support system comprising a longitudinal support bar with plates on one side for connection to the vehicle support arm and the screed support arm at varying possible extended positions, depending on the resulting width of the extended screed. A second component of the support system is an angular support which is connected at one end to the vehicle support arm at a point away from the screed and at the other end to the other side of the longitudinal bar.

Normally asphalt or other paving material is distributed by two flight feeders from the truck discharge hopper at the point of the paver to the screed at the rear. The right flight feeder feeds material to the section of the screed on the right of the centerline of the tractor, the left feeder doing the same for the left side of the screed. If the center of the screed is not at the centerline of the tractor, more material must be provided by the feeder feeding the longer section of the screed, causing one side of the hopper to discharge material at a faster rate, to supply the wider screed section, than the other side of the hopper, feeding the shorter screed section. This unequal flow rate from the respective right and left sides of the hopper causes problems in discharging the trucks dumping into the paver hopper. One side of the truck tends to empty while the other has material left. This causes spillage problems at the point the truck discharges into the paver and makes it difficult to discharge the truck completely. By using the present invention to deviate the screed division-line, which should correlate with the crown of the paved surface, from the center-line of the tractor, a more equal distribution of paving material can be provided by each of the paver feeders.

DETAILED DESCRIPTION OF THE INVENTION

Figure 1:
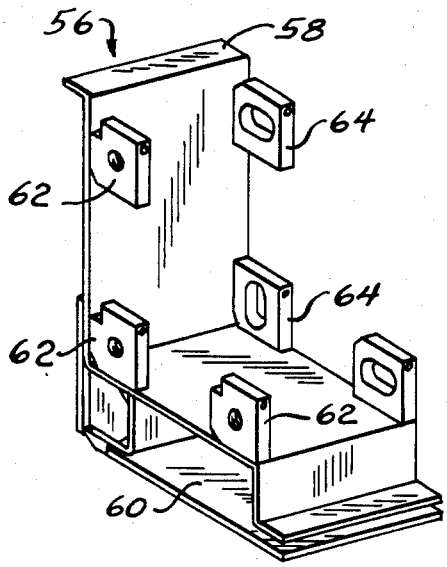
FIG. 1 is a perspective view of the extension section of the present invention.

The improved extendable screed, its component parts, and the method of paving a non-coplanar road may be understood by reference to the diagrams described above. Referring to FIGS. 1–4 the screed with inserted extension section is referred to generally as 20. The screed is comprised of strike plate (or screed) portions 22 and 24 which are held relative to one another by a flexible bottom plate 26 and a worm joint 28 at the top. Each strike plate portion 22, 24 is divided into parts; strike plate portion 22 is divided into parts 30 and 32, while strike plate portion 24 is divided into parts 34 and 36. These parts 30, 32, 34, 36 are reversibly held together by face plates which are welded to the interior of the parts such that when put in place they face each other. The face plates contain holes which receive bolts for reversibly holding them relative to the adjacent part, as shown at 38 and 40.

Bottom plate 26 is flexible, and worm joint 28 can move the top of strike plate portions 22 and 24 relative to one another about the flexible bottom so strike plate portions 22 and 24 can be oriented in a non-parallel orientation within the plane of the strike plate itself. This provides for a non-coplanar paving surface, as is more fully described below.

Figure 3:
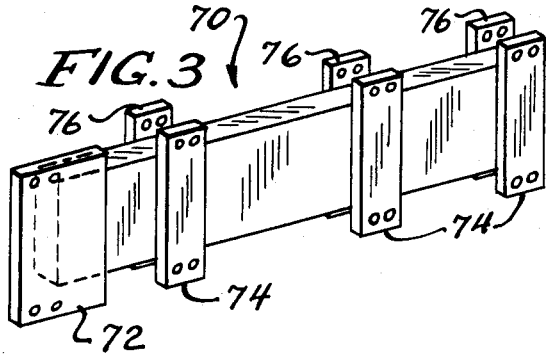
FIG. 3 is a perspective view of the longitudinal support of the present invention.
Figure 4:
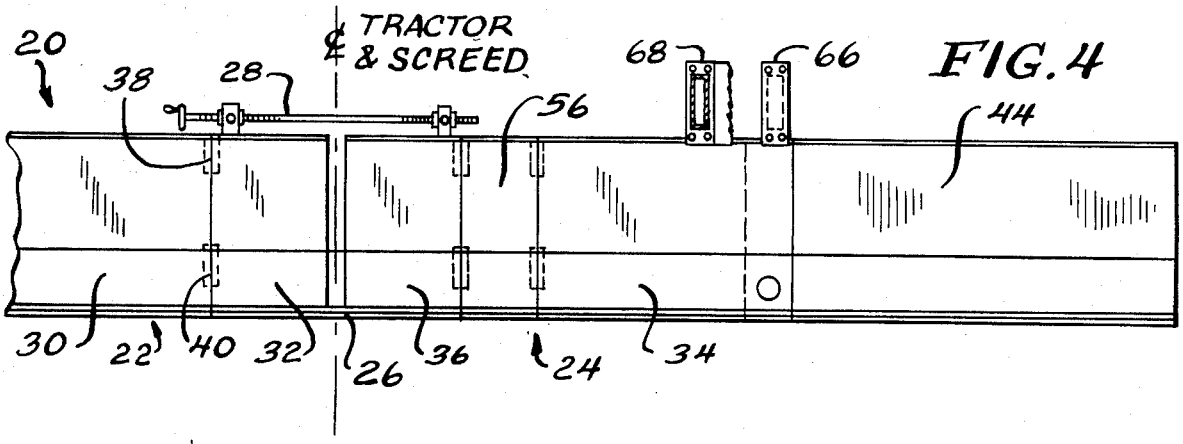
FIG. 4 is a sectional view taken through section line 4—4 shown in FIG. 5.
Figure 5:
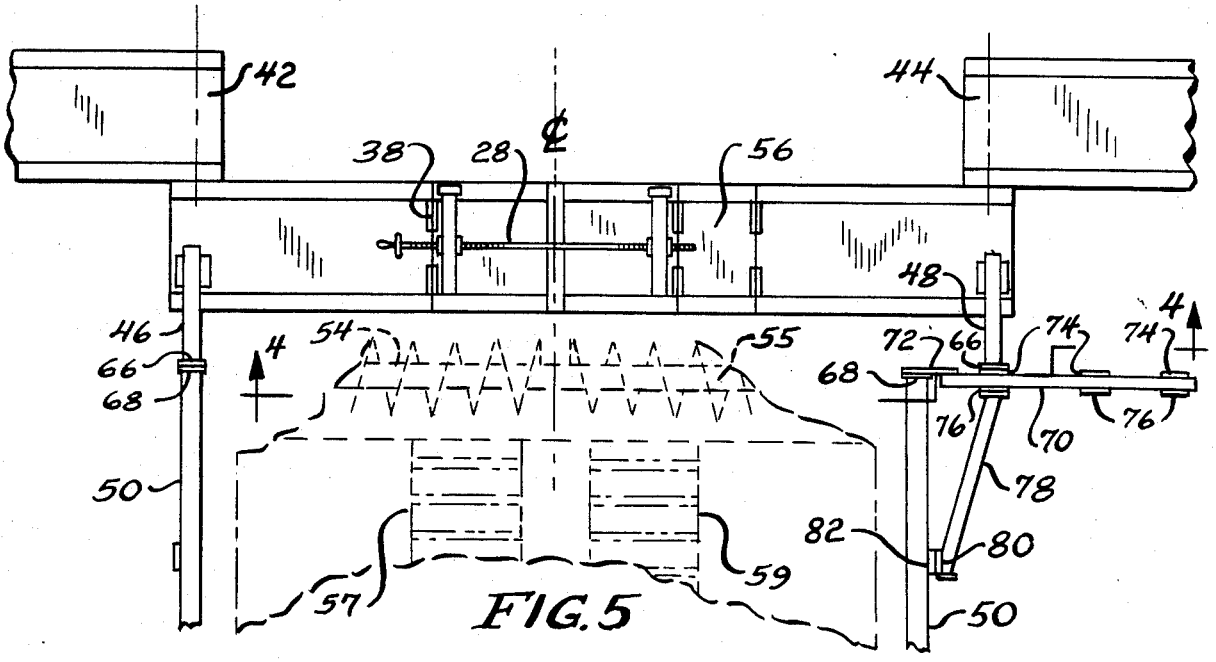
FIG. 5 shows a top planar view of the screed and associated supports showing an inserted extension section on one screed portion, and the auger and tractor in phantom partial cut-a-away.

Now referring to FIG. 5 in addition to FIGS. 1–4, the screed contains hydraulically operated mats 42 and 44 which allow the effective longitudinal dimension of the screed to be lengthened on one or both sides up to almost doubling the width of the screed. The screed has support arms 46 and 48 at either longitudinal end which, when the screed is not extended as provided in the present invention, are attached to vehicle support arms 50 and 52. Screw-augers 54 and 55, which spiral in opposite directions away from the tractor center-line, receive material from the paver hopper by way of flight feeders 57 and 59. Each feeder and its respective screw auger operate independently to feed material to the portion of the screed on that side of the tractor center-line.

The stroke plate portion can be increased in its longitudinal dimension by insertion of extension section 56, shown in FIG. 1, having lip 58 projecting in one direction and bottom 60 projecting in an opposite direction. The extension section is generally L-shaped but on its interior contains, near one longitudinal edge, face plates 62 welded to its inside and capable of receiving a bolt and, on the opposite longitudinal edge, face plates 64 with oblong apertures, also for receiving part of a bolt or other connecting piece. Section bottom 60 will be coplanar to bottom plate 26 when the section 56 is inserted in the screed. The cross-section of extension section 56 is very similar, if not the same as the cross-section of the screed.

Insertion of the extension section 56 in one strike plate portion 24, between strike plate parts 34 and 36 extends that strike plate portion by the longitudinal dimension of the extension section 56. Such width is normally about one foot, two feet, or in some cases three feet. The invention contemplates that three, four, five and six foot or greater extension sections can be built up by using a combination of one and two foot extension sections bolted to each other.

As shown in FIG. 4, the extension of the screed by the one foot section displaces one of the screed support arms 48 such that it will no longer fit against vehicle support arm 50. Normally, the interfaced plate 66 of the screed support arm would fit against interface plate 68 and be bolted together to adequately support the screed from the vehicle. However, because of the one foot displacement of the end of the stike plate portion the screed support arm 48 is now displaced by one foot longitudinally from the vehicle support arm 50.

A support bar 70 (shown in detail in FIG. 3) has distal plate 72 at one end projecting outwardly such that interface plate 68 of vehicle support arm 52 may be attached at one side thereof. Other plates 74 are welded or otherwise connected to the same side of the longitudinal support bar 70 and can be attached to screed support arm 48 if longer extension sections 56 are inserted.

Longitudinal support bar 70 has plates 76 welded or otherwise attached to receive one end of angular support 78 (shown in detail in FIG. 2) which can be bolted or otherwise reversibly connected to those plates. The angular support 78 near its opposite end has connector plate 80 which can be reversibly connected, usually by bolts, to plate 82 which is permanently welded on or otherwise attached to the vehicle support arm. This support system, comprising the longitudinal support bar, and the angular support bar, allows for the variable increase in one or both sides of the screed portions. The angular support 78 may be varied in angle or otherwise modified to be bolted opposite the screed support arm 48 at varying extension lengths.

As has been described earlier, the screw-auger 54 and 55 and flight feeders 57 and 59 distribute paving material to the screed sections on either side of the center-line of the tractor. The mats 42, 44, shown in the extended position in FIG. 5, receive an adequate supply of paving material but, due to the physics of the distribution process, a greater amount of paving material will be present against the mat closer to the main body of the screed and less will be distributed out towards the ends. Furthermore, it is noted that mats 42, 44 are subject to very significant torque forces due to pulling the paving material along during the paving process. Increased longitudinal dimension of these mats increases the rotational deflections to such an extent that the mat may be permanently damaged.

Another problem is created if one mat is not extended to the same extent as the other. Because the center-line of the auger is deviated from the center-line of the screed surface receiving the paving material, an uneven amount of paving material is provided to each side of the screed as define by the tractor center-line.

Figure 6:
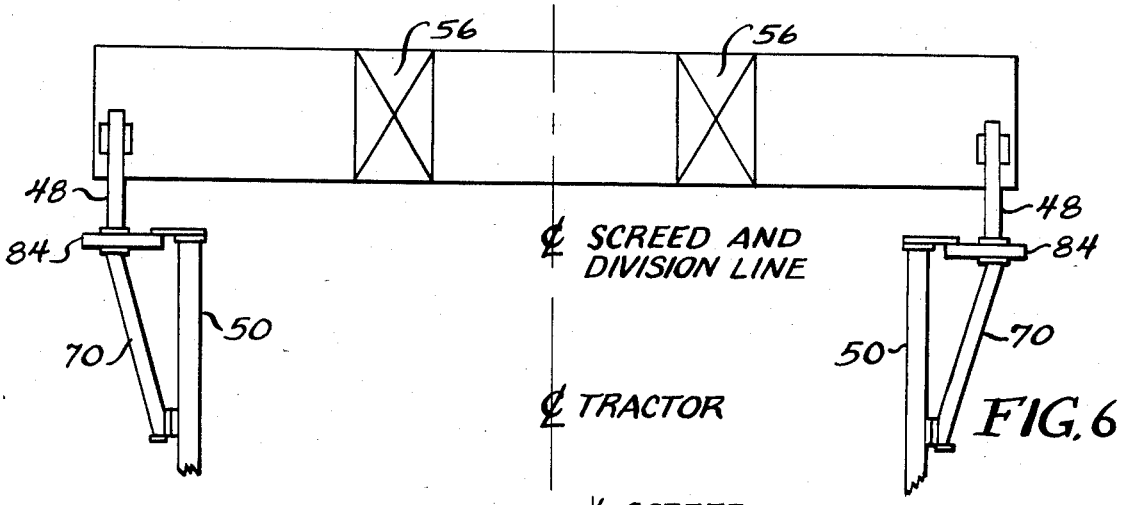
FIG. 6 shows a schematic, top planar view showing center-line of sceed having equal width insertions in both portions and aligned with the center-line on the tractor.

FIGS. 6–9 illustrate how the present invention may be used to accomplish a method of paving a non-coplanar surface while avoiding these problems. FIG. 6 shows inserts of equal longitudinal dimension, one on each portion of the strike plate. In such a case, the screed support arms 48 are displaced evenly on either side and the support system comprised of shortened longitudinal support bar 84 and angular support 70 maintain the division-line of the screed in line with the center-line of the tractor. The division-line of the screed also has been maintained with the center-line of the screed and the tractor. This arrangement allows an equal amount of paving material to be distributed to the screed to the right of the center-line as to the left of the center-line of the tractor, if the hydraulically extended mats are each extended an equal amount.

Alternatively, the support system could be extended twice as far on the right side (or left side) while the left support (right support) is maintained as before. This would shift the screed center-line by one section width (one-foot) while the screed is extended by a total of two section widths (two-feet).

Figure 7:
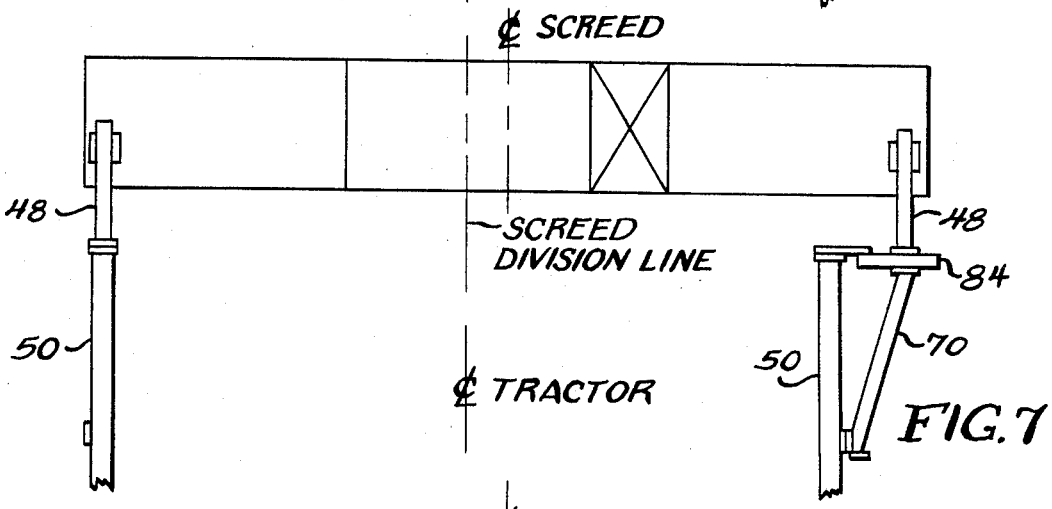
FIG. 7 shows a top planar schematic view of the screed having only one screed portion extended by an extension section, with division-line of the screed being maintained with the center-line of the tractor, but with screed center-line deviating from the tractor center-line.

The screed also may be extended on one portion alone by insertion of an extension section 56, as shown in FIG. 7. In this arrangement the division-line of the screed is maintained with the center-line of the tractor, even though the center-line of the screed has been shifted to the right of the tractor center-line.

Figure 8:
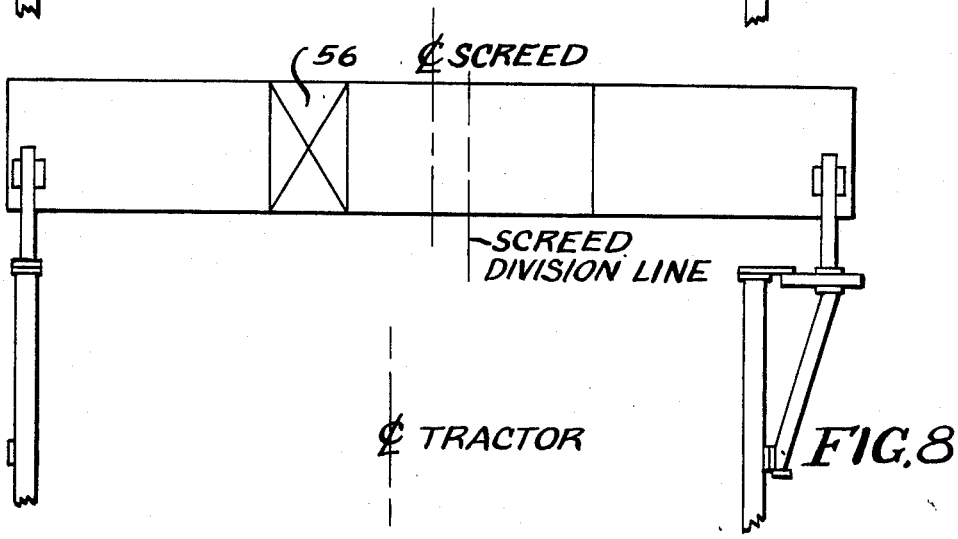
FIG. 8 shows a top planar schematic view of the screed with one screed portion extended by an extension section, with screed division-line displaced from the tractor center-line, but with screed center-line only partially displaced.

FIG. 8 shows another alternative arrangement provided by this invention. The extension section 56 is added to the left of the center-line while the longitudinal support bar and angular support are incorporated to the right of the center-line. This arrangement shifts the division-line of the screed by the amount of the extension section 56 whereas the center-line of the screed is shifted only one-half a section width.

Figure 9:
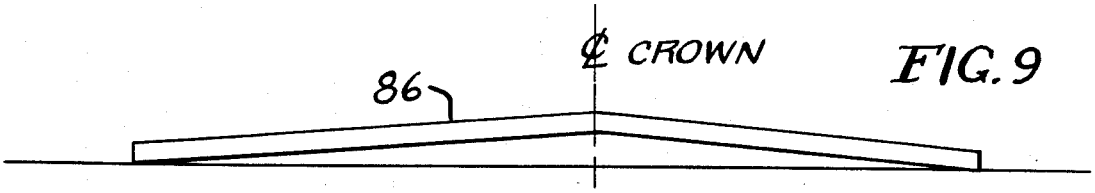
FIG. 9 shows the non-coplanar road surface and crown center-line with respect to the top planar schematic of FIG. 8.

FIG. 9 shows the center-line of the crown of the road 86 produced by the arrangement of FIG. 8 with mat extenders as shown. A wider section of road is paved to the left of the division-line and a shorter section to the right of the division-line while it is desireable for the tractor, the feeders and the screw-augers to provide a distribution of paving material near equal to either side of the tractor center-line. The present invention allows a greater variability in the screed dimensions on either side of the crown of a paved road, which is particularly desireable in the paving of the shoulder, but also provides more equal distribution of paving material from each of the paver feeders during such paving.

Figure 2:
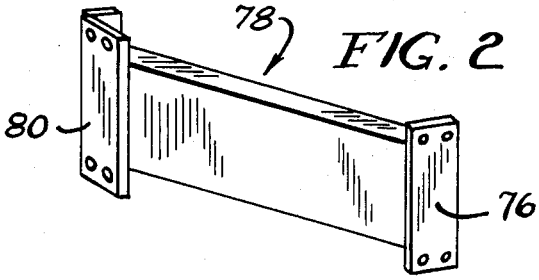
FIG. 2 is a perspective view of the angular support of the present invention.

The described components, particularly those shown in FIGS. 1–3, are made of heavy gauge steel or any other material known in the art by methods also known in the art. The other components shown in the pictures or otherwise described may be manufactured and made of materials known in the art.

From the above description it will be apparent that there is provided an improved extendable screed and method of paving with the desireable advantages described above, but which obviously are susceptible to modification in their form, method, operation, detailed construction and arrangement without departing from the principles involved. It is to be understood that the invention is not limited to the specific features shown, but that the means, method and construction herein disclosed comprise the preferred form of several modes of putting the invention into effect. The invention is, therefore, claimed in any of its forms or modifications within the legitimate and valid scope of the appended claims.

What is claimed is:

1. An improved extendable screed which can be pulled by a vehicle to pave roads having a crown, the screed divided into two portions adjustable relative to one another within the plane of the portions, the screed also having support arms for attachment to support arms of the vehicle, the improvement comprising:

the strike plate portion divided into separable parts reversibly attached together;

an extension section reversibly insertable between parts of the portion of the strike plate to increase its length;

support means for connecting the vehicle support arms with the screed support arms at one of a plurality of spaced points to accommodate an increase in screed length beyond the width of the vehicle and to selectively adjust the relative positions of the division-line between the screed portions and the center line of the vehicle;

whereby the screed may be connected to the vehicle by the respective support arms at variable widths and with variable placement of screed division line relative to vehicle center line.

2. The screed of claim 1 wherein the support means comprises a longitudinal extender reversibly connectable at one end to the vehicle support arm and, at positions toward the other end, means for reversible connection to the screed support arm, and the support means also comprises an angular support bar for reversible attachment between the vehicle support arm and the longitudinal extender.

3. The extendable screed of claim 2 wherein the longitudinal extender comprises a main bar with a plate attached at a first side of one end and departing longitudinally from the main bar which can be bolted to the vehicle support arm, and with additional plates connected along its length which can be bolted to the screed support arm, the longitudinal extender having at least one additional plate connected along a second side which can be bolted to the angular support arm.

4. A method of paving a road having at least two non-coplanar surfaces in a single pass of a vehicle pulling a screed, the screed comprised of two portions of variable orientation to one another within the plane of the portions to define the surface of the road, the portions defining a division-line therebetween, wherein the crown of the road diverges from the center-line of the vehicle, the method comprising the steps of:

(a) extending the portions of the screed to correspond with the width of the road desired to be paved in a single pass on each side of the divisionline beyond the width of the vehicle;

(b) orienting the screed so the division-line departs from the vehicle center-line and corresponds with the road crown;

wherein the center-line of the screed is maintained near the vehicle center-line.

5. A method of paving a road having at least two non-coplanar surfaces in a single pass of a vehicle pulling a screed, the vehicle having means to distribute paving material to the screed about the center-line of the vehicle, and the screed divided into two portions of variable orientation to one another within the plane of the portions to define a divisionline therebetween, wherein the road crown diverges from the center-line of the vehicle, the method comprising the steps of (a) extending each portion of the screed in the longitudinal dimension desired for the corresponding plane of the road surface beyond the width of the vehicle, (b) orienting the portions to define the planes of the road surface, the crown of the road located in line with the screed division-line, and (c) orienting the center-line of the screed near the center-line of the vehicle, whereby approximately equal longitudinal dimensions of the screed are located on each side of the vehicle center-line even through unequal planes of road are paved.

6. The method of claim 5 wherein one portion has larger longitudinal dimension than the other.

7. The method of claim 6 wherein the portion having larger longitudinal dimension comprises two parts with an extension section reversibly connected between the two parts.

* * * * *